United States Patent [19]

Garcia

[11] 4,029,347

[45] June 14, 1977

[54] SUPPORT STAND ASSEMBLY

[76] Inventor: Gilbert Garcia, 4107 San Pedro, Tampa, Fla. 33609

[22] Filed: Oct. 8, 1976

[21] Appl. No.: 730,847

[52] U.S. Cl. ..... 289/18; 211/189; 248/122

[51] Int. Cl.[2] ..... D03J 3/00

[58] Field of Search ..... 28/15; 289/1.2, 1.5, 289/18; 248/122, 124, 125, 157, 165; 211/189; 160/135, 377

[56] References Cited

UNITED STATES PATENTS

| | | | |
|---|---|---|---|
| 835,678 | 11/1906 | Hammond | 248/124 |
| 1,961,119 | 5/1934 | Ettinger | 248/122 X |

OTHER PUBLICATIONS

*Building Craft Equipment* , by A. J. and C. W. Abrams, Praeger Publishers, N. Y. copyright 1976 pp. 112–114.

*Primary Examiner*—Louis K. Rimrodt
*Attorney, Agent, or Firm*—Duckworth, Hobby, Orman, Allen & Pettis

[57] ABSTRACT

A support stand assembly primarily designed for the adjustable support and positioning of work articles such as macrame, woven rugs, tapestry or the like, while such work is being formed by an operator. A base has a primary support element connected thereto and extending upwardly in an elongated manner so as to maintain and adjustably position the work being formed at various heights along its length. A retaining cable and pulley assembly are cooperatively attached to one another and adjustably positioned on the head portion of the primary support element for regulating and selectively adjusting the position or height of the work relative to the height of the operator performing the work on the article.

9 Claims, 4 Drawing Figures

SUPPORT STAND ASSEMBLY

BACKGROUND OF THE INVENTION

1. Field of the Invention

This invention relates to a stand specifically designed to adjustably position and maintain a woven material type article such as macrame, woven rugs, etc., in predetermined positions relative to an operator performing work on the article wherein the stand may be mobile, and sufficiently versatile to handle a number of different articles primarily through the adjustment of the height of the article during work performance thereon.

2. Description of the Prior Art

Woven cloth products or articles have been in existence and utilized for various purposes for numerous years. More specifically, articles such as rugs, tapestry and the like have been utilized for centuries not only as functional products but as works of art. While various methods utilized in the forming of such woven cloth articles vary greatly, it is common practice to use some type of support table, stand or generally supported structure on which to form the device.

With the advent of modern technology, the average person has enjoyed an increasing amount of free time in which to practice pursuits other than their chosen profession or job. Accordingly, there has been an increase in the popularity and variety of leisure time hobbies. A number of these hobbies have taken the form of craft development including weaving and the creative forming of various types of similar woven cloth articles.

In particular, the popularity of macrame has increased greatly and is currently being practiced by young and old alike and also people generally considered as handicapped. In the performance of forming the macrame product, long hours must be spend forming the article and otherwise causing hand manipulation of the material used to form the macrame product. It is quite apparent that while enjoyable, this process can become extremely tiresome. This is especially true in view of the fact that the product is usually formed by attaching it in a downwardly extending fashion to some type of support device wherein the operator normally stands and then moves about the article performing the various necessary hand manipulations in order to accomplish the finished product.

Conventional techniques such as those described above, while being tiresome, as pointed out, also does not lend itself to being accomplished by the handicapped or by older people who cannot comfortably spend the hours necessary in a standing up position.

There is, therefore, a recognized need in the industry for some type of support structure which would allow adjustable positioning of the macrame or like product relative to the worker so as to eliminate the discomforting process of performing the work in a standing up position. Obviously, there are numerous support type stands or racks which are primarily designed to serve as display stands or clothing racks which, while possibly adaptive to the performance of forming a macrame product, are not particularly efficient or suited to such an adaptation. The U.S. Pat. No. to Brown, 3,955,787; Kurtz, 2,789,703; and Shewbridge, 2,201,744, are representative of various patented and prior art devices which are specifically designed to accomplish a supportive type function for various articles. However, none of the structures disclosed in these prior art patents and by far the majority of such similarly constructed stand assemblies which are commericially available are specifically adapted to the adjustable positioning of a woven or like article, including macrame, while such article is being formed.

Therefore, the need exists for a support stand assembly which is capable of adjustably positioning an article, of the type described, and maintain a predetermined position of this article during various stages of its formation. In addition, such a stand assembly should be of relatively simple design and manufacture so as to enable low cost of maintenance and low cost of initial purchase. In addition, such a structure should be capable of being relatively mobile and structured such that the performance of work on the product can be accomplished in a comfortable sitting or similar type position irrespective of the age, agility or general physical prowess of the worker performing the macrame or like process.

SUMMARY OF THE INVENTION

This invention is directed towards a support stand assembly primarily designed to maintain and adjustably position a macrame or similar woven type product such that work can be formed thereon, during its formation, by a worker who is disposed in a comfortable, sitting position. To accomplish the desired positioning of the macrame or like product, the subject support stand assembly comprises a base means, preferably having a plurality of legs so as to offer proper support to a primary support means. The primary support means comprises an elongated rod like configuration attached to the base and extending upwardly therefrom a predetermined distance so as to maintain the entire article in a substantially downwardly extending position thereby allowing hand manipulation to be performed thereon in the conventional manner.

In the preferred embodiment, the primary support means may include a plurality of support elements detachably connected to one another in end-to-end, substantially aligned relation so as to form the elongated configuration.

The primary support means further comprises a head portion disposed to substantially define the distal end of the elongated rod like configuration. The head portion comprises a leg like element extending substantially outwardly from the longitudinal axis of the plurality of support elements and in substantially overhanging relationship to the work area wherein the article or product being formed is disposed during such formation.

An auxiliary support means is generally attached to the head portion and extends outwardly therefrom and also outwardly from the longitudinal axis of the remainder of the primary support means. By virtue of this disposition proper support may be provided, at a plurality of points, to an article or work product of the type performed on spread apart forming poles or like structure.

The support stand assembly of the present invention further comprises a retention means in the form of a flexible cable or the like disposed to have one end fixedly but removably attached to a portion of the primary support means or substantially correspondingly positioned structure of the support stand itself, and the opposite end supportingly attached to the article being formed. A connection means which, in the preferred embodiment, comprises a pulley arrangement which is mounted or attached to a distal portion of the primary support means.

In one embodiment of the present invention, the connection means comprises a pulley member attached to the head portion and movable in supporting engagement along the length of the cable means. Accordingly, the disposition of the pulley assembly is such as to have the article attached to the free end of the cable assembly be positioned in the work area or in substantially spaced relation below the head portion. By virtue of the movability of the able means relative to the head portion and/or the primary support means, mere adjusting of the cable means relative to the pulley will automatically serve to position or determine the height of the article relative to a supporting surface. More importantly, the product itself can be adjusted relative to a sitting position of the worker serving to form the macrame product. Again, adjustment of the height of the product being formed can be accomplished merely by raising or lowering the entire cable assembly by virtue of the engagement between the cable means and the pulley assembly establishing a movable connection therebetween.

Other structural features of the present invention include a type of gauge means comprising a plurality of and at least two outwardy extending fingers mounted on the elongated rod which forms the primary support means. The spacing of the outwardly extending fingers is predetermined to measure one yard which is the normal length utilized in the various yarn type material used to form the macrame product. Merely looping, in a continuous fashion, the yarn, thread or like material about the outwardly extending fingers automatically establishes a plurality of lengths each having a longitudinal dimension of approximately one yard. This, of course, is due to the one yard distance between the outwardly extending fingers comprising the gauge means as previously set forth.

A brace means is further provided and mounted on the base means to extend upwardly therefrom in substantially corresponding position relative to the primary support means. An interconnecting linkage or like element may be attached to both the brace means and the primary support means so as to provide additional support and integrity required by the primary support means due to its relatively great height or distance it extends upwardly from the base means.

Therefore, in operation, the macrame or like article being formed is merely attached to the free end of the cable means. The cable means is thereby adjusted by virtue of its movable interconnection with the pulley assembly to establish a predetermined, comfortable height of the article relative to the ground or supporting surface on which the stand is mounted. This also will coincide with the same height that may be desirable for the worker to operate while at the same time maintain a sitting or otherwise comfortable position. As work on the product progresses, the cable assembly is again adjusted having its opposite end to which the article is attached fixedly connected to a portion of the support stand assembly after the cable assembly is adjusted to position the article being formed at a higher position relative to the ground and, of course, the operator performing the work.

The invention accordingly comprises the features of construction, combination of elements, and arrangement of parts will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
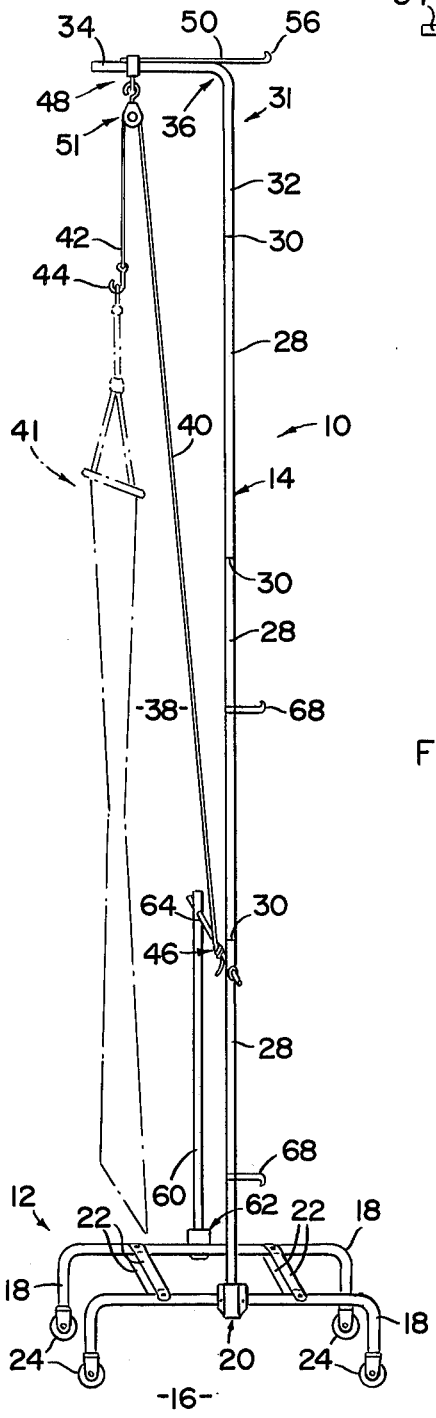
FIG. 1 is a perspective view of the support stand assembly of the present invention without the work article being mounted thereon.

As best shown in FIG. 1, the support stand assembly of the present invention is generally indicated as 10 and comprises a base means generally indicated as 12 disposed in substantially supporting relation to a primary support means 14 relative to a ground or support surface 16.

Figure 2:
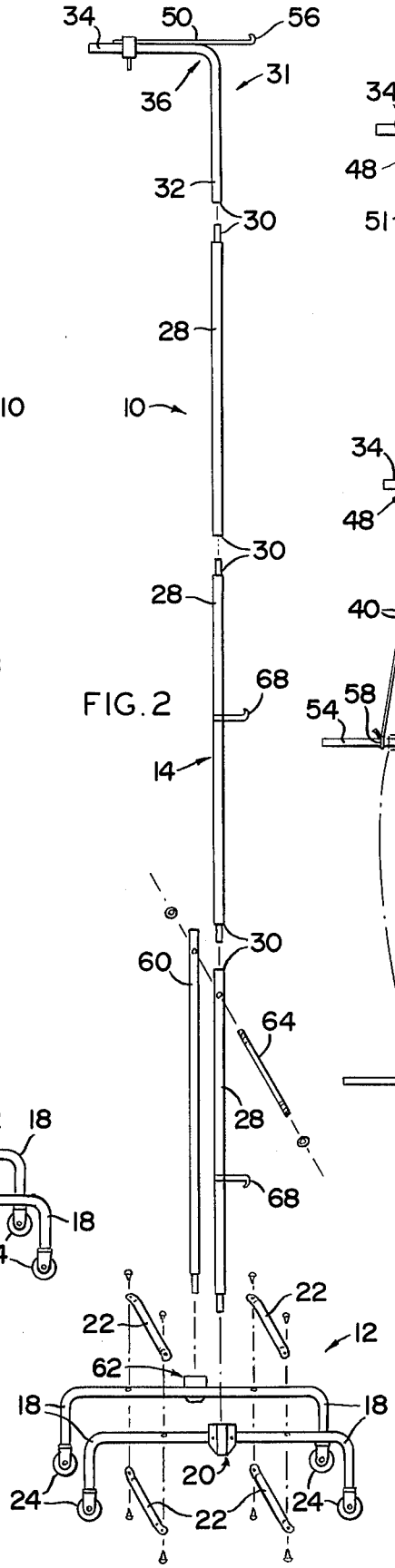
FIG. 2 is an exploded view of the various components comprising the primary support means as well as the base of the subject support stand assembly.

With primary reference to FIGS. 1 and 2, the base means 12 includes a plurality of legs 18 disposed in substantially spaced apart relation to one another or otherwise disposed so as to define a sufficient support platform to provide proper support to the elongated rod like primary support means 14. Interconnection of the primary support means 14 to the base may occur as at 20 which may be defined as either a fixed or detachable interconnection. The detachable interconnection 20 serves to allow ready disassembly of the support stand assembly for the purpose of transportation or storage of the assembly. Interconnecting attachments 22 may be provided in interconnecting relation between the various legs 18 so as to add to the support thereof and in addition provide more substantial support to the primary support means 14.

One embodiment of the present invention comprises the provision of coaster means 24 attached to the end of each of the plurality of legs 18 and disposed in movable interconnection between the supporting surface or ground 16 and the legs 18. The rollers may take any conventional configuration or design and are essentially disposed and configured to allow the entire support stand assembly to become mobile so as to be readily moved between various positions and also to allow easy movement or orientation of the entire support stand assembly during the process of working or forming the macrame or like product.

The primary support means of the present invention, in one embodiment, comprises a plurality of support elements 28 (FIG. 2) disposed in interconnected, substantially aligned relation to one another. More particularly, the various interconnections as at 30 serving to interconnect the various support elements are specifically disposed and configured to allow a detachable but yet aligned interconnection between the support elements. More specifically, in the preferred embodiment, the various support elements 28 are detachably connected to one another in a colinear or coaxial relationship so as to at least partially define the elongated rod like configuration of the primary support means 14. Accordingly, it is thereby evident that the height of the primary support means 14 is dependent upon the longitudinal dimension and number of the plurality of support elements 28 and accordingly can be varied by insertion or removal of any one or more of the support elements 28 to define the height of the primary support means 14.

A head portion generally indicated as 31 (FIGS. 1 and 3) comprises a base leg 32 and support leg 34 integrally or otherwise attached to one another at a substantially angled junction 36. The support leg 34, therefore, is maintained in a substantially overhanging relation to the work area generally defined by numeral 38 wherein the article 41 being worked on is maintained.

The support stand of the present invention further comprises a retention means in the form of a cable assembly 40 having one end 42 being attachable to the work product 41 by a substantially conventional attachment device 44. The opposite end of the cable means 40 is disposed for fixed but detachable connection to some other remaining portion of the support stand assembly as at 46. The cable assembly 40 is movably attached and supported to a distal portion of the primary support means 14 as at 48. In particular, the preferred embodiment represents the interconnection of the cable assembly 40 to the head portion 31 and, more particularly, to the support leg 34 thereof. A connection means 50 may be in the form of a pulley assembly disposed to supportingly engage the cable means 40 along the length thereof to provide for movable adjustment of the cable assembly and in turn movable, adjustable positioning of the work product 41 to accommodate the position of the worker (not shown) within the working area 38. Therefore, the worker may be disposed and maintain a sitting or desired comfortable position during his working time on the work product 41.

Figure 3:
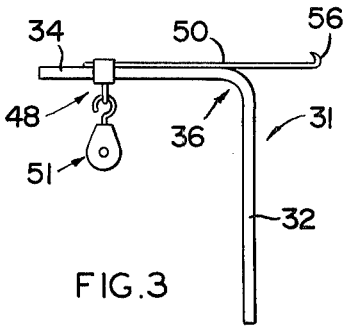
FIG. 3 is a detail view, in partial cutaway, of the head portion of the present invention.
Figure 4:
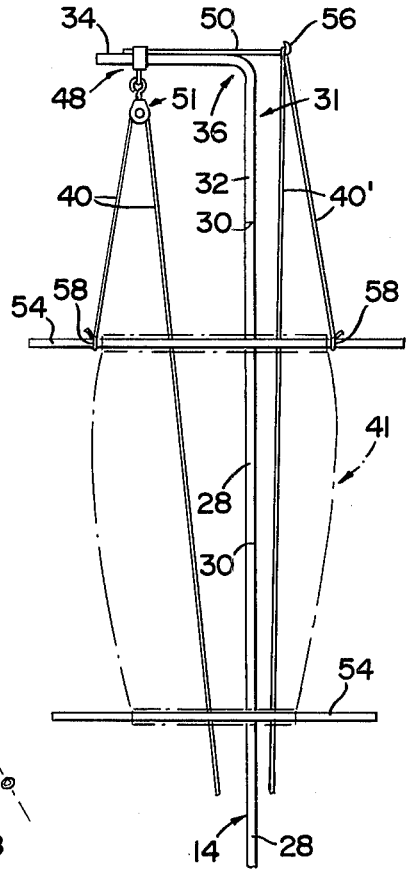
FIG. 4 is another embodiment of the present invention showing different methods of formation of a macrame or like article product utilizing support poles adjustably attached to the head portion and auxiliary support means.

The support stand assembly of the present invention further comprises an auxiliary support means 50 disposed to extend substantially outwardly from the longitudinal axis of the primary support means 14 and also in spaced relation to the support leg 34 of the head portion 31. In the preferred embodiment, the auxiliary support means 50 is extended or disposed in aligned relation and extending in essentially opposite direction relative to the support leg 34 as best shown in FIGS. 1, 3 and 4. The purpose of the auxiliary support means 50 will become evident with regard to the structure of FIG. 4 wherein the work product is, during its formation, disposed for mounting on poles 54. In this type of product proper support must be provided to the product 41 by spaced supporting engagement of the retention means to the pole itself 54. Accordingly, in this embodiment, the retention means includes a first cable assembly 40 and a second cable assembly 40'. The first cable assembly 40 is attached through pully assembly 51 as previously explained. The second cable assembly or cable means 40' is disposed along its length in supporting engagement with the auxiliary support means 50 as at 56. Therefore, one end of the cable assembly 40' is attached to the pole 54 as at 58 while the opposite end is fixedly but detachably mounted on the primary support means 14 or other portion of the support stand assembly.

Another structural feature of the present invention comprises a brace means 60 attached to the base means 12 as at 62. The brace means 60 extends outwardly from the base means in position so as to engage or be interconnected by linkage 64 to the primary support means 14. This interconnection is supplied to provide additional supported engagement of the primary support means 14 which is generally required due to its relatively great height. Stability is, therefore, increased.

The support stand assembly of the present invention further comprises a gauge means comprising a plurality of finger elements 68 extending outwardly from the primary support means and, more importantly, disposed in spaced apart relation from one another a predetermined distance. In the preferred embodiment, this predetermined spaced apart distance equals approximately 1 yard. Therefore, the material, yarn, thread, etc., used to form the macrame or like woven product is wound or looped back of the spaced apart extending finger 68. Accordingly, predetermined lengths of approximately a predetermined distance (one yard is normally desired) are established.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A support stand assembly of the type primarily designed to support an article while work is being performed thereon, said support stand assembly comprising: base means disposed in supporting relation to a remaining portion of said support stand assembly, a primary support means comprising a substantially elongated configuration and connected to said base means and extending substantially upwardly therefrom, article retention means including cable means movably attached to a substantially distal portion of said primary suport element and disposed for attachment to the article, whereby the article may be positioned at various heights along the length of said primary support means and at a predetermined position relative to one performing work on the article.

2. A support stand assembly as in claim 1 wherein said primary support means includes a plurality of support elements interconnected to one another in a substantially alignyd, colinear relation to one another, said plurality of support elements detachably interconnected to one another, whereby the length of said primary support means may be regulated.

3. A support stand assembly as in claim 1 comprising a head portion disposed in spaced apart relation from said base means along the length of said primary support means, said head portion configured to at least partially extend outwardly from the longitudinal axis of said primary support means; said cable means attached to said head portion and adjustably positioned relative thereto.

4. A support stand assembly as in claim 3 further comprising a connection means mounted on said head portion and movably interconnecting said cable means to said primary support means, whereby the article may be disposed at various heights along the length of said primary support means.

5. A support stand assembly as in claim 4 whereby said connecting means comprises a pulley assembly attached to said head portion and movably engaging the length of said cable means, one end of said cable means disposed and configured for supporting attachment to the article and the other end disposed for fixed attachment to a remaining portion of said support stand assembly, whereby the height of the article being worked on, relative to said primary support means, may be adjustably established and maintained.

6. A support stand assembly as in claim 3 further comprising an auxiliary support means connected to said head portion and extending outwardly from the longitudinal axis of said primary support means, said cable means disposed for supported engagement with both said head portion and said auxiliary support means ans in supporting engagement with the article, whereby the article is maintained in depending relation from said head portion and said auxiliary support means.

7. A support stand assembly as in claim 1 further comprising brace means connected to said base means and extending outwardly therefrom, said brace means attached to said primary support means, whereby added support is provided said primary support means.

8. A support stand assembly as in claim 1 further comprising gauge means including a plurality of finger elements mounted on said primary support means and extending outwardly therefrom, at least two of said finger elements being disposed a predetermined spaced apart distance from one another, whereby material from which the article is formed is mountable on each of said finger elements and accordingly premeasured by said predetermined distance between said finger elements.

9. A support stand assembly as in claim 1 wherein said base means comprises a plurality of legs disposed in spaced apart relation to one another, coaster means mounted on one end of each of said plurality of legs, whereby said support stand assembly is mobile over a support surface on which it is mounted.

* * * * *

UNITED STATES PATENT AND TRADEMARK OFFICE

CERTIFICATE OF CORRECTION

PATENT NO. : 4,029,347

DATED : June 14, 1977

INVENTOR(S) : Gilbert Garcia

It is certified that error appears in the above-identified patent and that said Letters Patent are hereby corrected as shown below:

Column 6, line 59, delete "alignyd" and insert therefor --aligned--.

Column 7, line 25, delete "ans" and insert therefor --and--.

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*